United States Patent [19]

Hindle et al.

[11] 4,069,066

[45] Jan. 17, 1978

[54] METHOD AND COMPOSITION FOR CLEANING POLISHED SURFACES

[75] Inventors: Peter Hindle, Sycamore Township, Hamilton County; William James Welsh, Springdale, both of Ohio

[73] Assignee: The Procter & Gamble Company, Cincinnati, Ohio

[21] Appl. No.: 739,159

[22] Filed: Nov. 10, 1976

[51] Int. Cl.[2] ..... B08B 3/08; C11D 3/04; C11D 3/30

[52] U.S. Cl. ..... 134/6; 134/42; 252/106; 252/544; 252/545; 252/546; 252/547; 252/54 B

[58] Field of Search ..... 134/6, 42; 252/106, 252/544, 545, 546, 547, 548

[56] References Cited

U.S. PATENT DOCUMENTS

| | | | |
|---|---|---|---|
| 3,329,609 | 7/1967 | Blomfield | 252/106 X |
| 3,580,853 | 5/1971 | Parran | 252/547 |
| 3,992,146 | 11/1976 | Fazzalari | 252/106 X |

FOREIGN PATENT DOCUMENTS

| | | | |
|---|---|---|---|
| 7,224,821 | 7/1972 | Japan | 21/55 |

*Primary Examiner*—Robert L. Lindsay, Jr.
*Assistant Examiner*—Marc L. Caroff
*Attorney, Agent, or Firm*—Douglas C. Mohl; Richard C. Witte; Thomas H. O'Flaherty

[57] ABSTRACT

Hard-surface cleaning compositions especially suited for cleaning polished surfaces contain amine compounds as impurities and a sufficient amount of a metal ion to complex the amines thereby preventing them from attacking the polish composition. Methods of using the compositions are also provided.

13 Claims, No Drawings

METHOD AND COMPOSITION FOR CLEANING POLISHED SURFACES

BACKGROUND OF THE INVENTION

The present invention relates to hard-surface cleaning compositions especially suited for the cleaning of polished surfaces and methods of using such compositions.

The cleaning of hard surfaces with a variety of compositions is old in the art. The compositions have taken the form of granular solids or liquids while containing such things as scouring and bleaching agents in addition to cleaning surfactant compounds. The interest in providing such compositions, particularly those in liquid form, with antibacterial effectiveness is evidenced by many patents and literature references. Achieving such effectiveness has been the result of using phenolic compounds or quaternary ammonium or other nitrogenous compounds. The presence of such nitrogenous compounds also means that amine impurities are likely to be present. These impurities present a variety of problems, some of which are particularly acute when the compositions are used on polished surfaces.

Many modern floor polishes use carboxyl-containing acrylic copolymers as the basis for detergent and acid resistant, ammonia-removable floor polishes. These copolymers are formed by using a high proportion of acrylic and methacrylic acids, and they are usually cross-linked with a polyvalent metal ion, commonly zirconium or zinc, to form a durable film. This film can be removed with a cleaning solution containing ammonia, the ammonia forming a soluble metal ammoniate complex.

Since the above-mentioned floor polishes are removable by the use of ammonia, the amine impurities which are present in compositions of the instant invention can, through the same chemical interaction, cause the polish to soften and be susceptible to removal. This is undesirable since the polish in such a condition may have a sticky feel and the polished surface will have an unclean, streaky appearance.

It has been found in the present invention that the aforementioned problems can be diminished by the addition of a small amount of a water-soluble metal ion salt to the cleaning composition. It is believed that the metal ion of the salt complexes the amines present thereby preventing them from weakening the cross-linked polish.

It is, therefore, an object of the present invention to provide hard-surface cleaning compositions wherein the tendency of the compositions to soften polishes is substantially reduced.

It is a further object of the present invention to provide a superior method of cleaning polished surfaces.

These and other objects of the present invention will become obvious from the discussion of the invention which appears hereinafter.

PRIOR ART

As indicated hereinabove, extensive work has been done in the area of cleaning compositions containing quaternary ammonium compounds and other nitrogenous compounds such as amines and zwitterionic surfactants. Included among references which disclose such compositions are Voss, U.S. Pat. No. 3,507,796, issued Apr. 21, 1970; Freese, U.S. Pat. No. 3,093,591, issued June 11, 1963; Hibbs, U.S. Pat. No. 2,541,248, issued Feb. 13, 1951; Herrick et al., U.S. Pat. No. 3,247,119, issued Apr. 19, 1966; Lancz, U.S. Pat. No. 3,812,046, issued May 21, 1974; Gaines, U.S. Pat. No. 3,560,390, issued Feb. 2, 1971; Dadekian, U.S. Pat. No. 3,836,699, issued Sept. 17, 1974; and Japanese Patent Application -084471 T28, published July 7, 1972.

SUMMARY OF THE INVENTION

The present invention, in its composition aspect, relates to aqueous hard-surface cleaning compositions comprising an amine derived nitrogenous surfactant, amine impurities which are present as the result of being introduced with the surfactant, a water-soluble salt of a metal ion which is capable of complexing amines in an amount such that the molar ratio of metal salt to amine is from about 1:1 to 1:4 and water. The pH of the present compositions is from about 6 to 8.

In its method aspect the present invention is related to the use of the above-described compositions to clean hard surfaces without adversely softening the polish which may be present on such surfaces.

DETAILED DESCRIPTION OF THE INVENTION

The present compositions comprise several components each of which is described in turn below.

Nitrogenous Surfactant

The amine derived nitrogenous surfactant for use in the present invention can be selected from a wide variety of materials. Included among such materials, and those which are preferred for use herein, are cationic, ampholytic and zwitterionic surfactants. In addition, certain nonionics are also preferred. Cationic surfactants are preferred components when it is desired to have the compositions possess bactericidal activity.

The cationic surfactants include such materials as

A. quaternary ammonium compounds having the formula

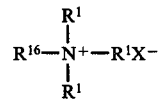

wherein $R^{16}$ is an alkyl radical containing from about 6 to about 22 carbon atoms, from 0 to about 2 halogen atoms, and from 0 to about 1 additional quaternary ammonium group having the formula

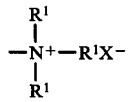

said quaternary ammonium group being attached so that there is at least one alkyl moiety of at least about 6 carbon atoms containing no amine group or quaternary ammonium group as a substituent, and each $R^1$ group is selected from the group consisting of alkyl groups containing from 1 to about 22 carbon atoms, mono halogen substituted alkyl groups containing from 1 to about 3 carbon atoms, benzyl groups and hydroxyl alkyl groups containing from 1 to 3 carbon atoms, said halogen atoms and said hydroxyl groups being substituted on any of the carbon atoms in the alkyl groups and wherein X is selected from the group consisting of iodide, bromide, methylsulfate, ethylsulfate and chloride anions;

B. N-alkyl pyridinium halides wherein the alkyl group contains from about 6 to about 18 carbon atoms;

C. 2-alkyl quaternary imidazolinium salts wherein the alkyl group contains from about 8 to about 18 carbon atoms;

D. polyquaternary ammonium compounds having the formula:

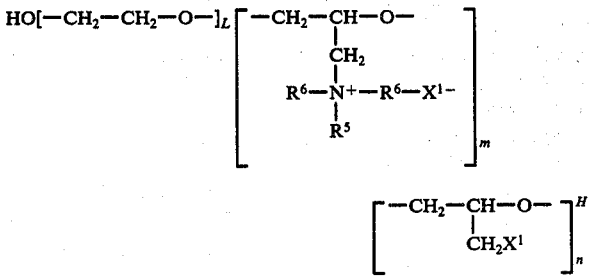

wherein $R^5$ is a hydrocarbon group containing from 1 to about 24 carbon atoms, wherein said $R^6$ group is a hydrocarbon group containing from 1 to about 4 carbon atoms, wherein $X^1$ is selected from the group consisting of chlorine, iodine, and bromine atoms, wherein L, *m* and *n* are integers such that L is an integer from 0 to about 50, the sum of *m* and *n* is from 2 to about 50, and the sum of *m, n* the number of carbon atoms in $R^5$ is greater than 12;

E. organosilicon quaternary ammonium halides

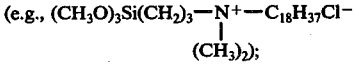

F. bisbiguanides (e.g., 1,1'-hexamethylene bis[5-(p-chlorophenyl)biguanide]; and G. mixtures thereof.

While any of the above types of cationic surfactants are suitable for use herein certain ones are preferred. Included in the preferred group are dialkyldimethylammonium chloride, alkyldimethylbenzylammonium chloride, alkyl pyridinium chloride, alkyl trimethylammonium chloride, and mixtures thereof. The alkyl group in such compounds preferably being from about 6 to 18 carbon atoms. It should be appreciated that the anionic portion of such salts can be other halogens such as bromide or groups such as methylsulfate.

The ampholytic synthetic detergents can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-solubilizing group, e.g., carboxy, sulfonate, sulfato. Examples of compounds falling within this definition are sodium 3-(dodecylamino)propionate,
sodium 3-(dodecylamino)propane-1-sulfonate,
sodium 2-(dodecylamino)ethyl sulfate,
sodium 2-(dimethylamino)octadecanoate,
disodium 3-(N-carboxymethyldodecylamino)propane-1-sulfonate,
disodium octadecyl-iminodiacetate,
sodium 1-carboxymethyl-2-undecylimidazole, and
sodium N,N-bis(2-hydroxyethyl)-2-sulfato-3-dodecoxypropylamine.

The zwitterionic synthetic detergents useful herein can be broadly described as derivatives of aliphatic quaternary ammonium and phosphonium or tertiary sulfonium compounds, in which the cationic atom may be part of a heterocyclic ring, and in which the aliphatic radical may be straight chain or branched, and wherein one of the aliphatic substituents contains from about 3 to 18 carbon atoms, and at least one aliphatic substituent contains an anionic water-solubilizing group, e.g., carboxy, sulfonate, sulfato, phosphato, or phosphono. Examples of compounds falling within this definition are 3-(N,N-dimethyl-N-$C_{8-21}$ alkylammonio)-2-hydroxypropane-1-sulfonate,
3-(N,N-dimethyl-N-dodecylammonio)acetate,
3-(N,N-dimethyl-N-dodecylammonio)-propionate,
2-(N,N-dimethyl-N-octadecylammonio)ethyl sulfate,
2-(trimethylammonio)ethyl dodecylphosphonate,
ethyl 3-(N,N-dimethyl-N-dodecylammonio)propylphosphonate,
sodium 2-(N,N-dimethyl-N-dodecylammonio)ethyl phosphonate,
1-(2-hydroxyethyl)-2-undecylimidazolium-1-acetate,
2-(trimethylammonio)octadecanoate, and
3-N,N-bis-(2-hydroxyethyl-N-octadecylammonio)-2-hydroxypropane-1-sulfonate.

Some of these detergents are described in the following: U.S. Pat. Nos. 2,129,264; 2,178,353; 2,774,786; 2,813,898; and 2,828,332. The ammoniopropane sulfonates containing about 8 to about 21 carbon atoms are one class of detergent compounds preferred herein.

Amine derived nitrogenous nonionic surfactants are also included herein. Such compounds may be derived from the condensation of ethylene oxide with the product resulting from the reaction of propylene oxide and ethylene diamine. For example, compounds containing from about 40 to about 80 percent polyoxyethylene by weight and having a molecular weight of from about 5,000 to about 11,000 resulting from the reaction of ethylene oxide groups with a hydrophobic base constituted of the reaction product of ethylene diamine and excess propylene oxide, said base having a molecular weight of the order of 2,500 to 3,000, are satisfactory.

Additional amine derived nonionics are those having the formula $R^1R^2R^3N \rightarrow O$ (amine oxide detergent) wherein $R^1$ is an alkyl group containing from about 10 to about 28 carbon atoms, from 0 to about 2 hydroxy groups and from 0 to about 5 ether linkages, there being at least one moiety of $R^1$ which is an alkyl group containing from about 10 to about 18 carbon atoms and 0 ether linkages, and each $R^2$ and $R^3$ are selected from the group consisting of alkyl radicals and hydroxyalkyl radicals containing from 1 to about 3 carbon atoms.

Specific examples of amine oxide detergents include: dimethyldodecylamine oxide, dimethyltetradecylamine oxide, ethylmethyltetradecylamine oxide, cetyldimethylamine oxide, dimethylstearylamine oxide, cetylethylpropylamine oxide, diethyldodecylamine oxide, diethyltetradecylamine oxide, di-propyldodecylamine oxide, bis-(2-hydroxyethyl)dodecylamine oxide, bis-(2-hydroxyethyl)-3-dodecoxy-1-hydroxypropylamine oxide, (2-hydroxypropyl)methyltetradecylamine oxide, dimethyloleyamine oxide, dimethyl-(2-hydroxydodecyl)amine oxide, and the corresponding decyl, hexadecyl and octadecyl homologs of the above compounds.

Other surfactants include bis-(N-2-hydroxyethyl) lauramide and lauramide condensed with 15 moles of ethylene oxide per mole of lauramide.

The nitrogenous surfactant in the compositions of the present invention can be a mixture of such surfactants and is generally present in a total amount of about 0.5% to 20% by weight of the composition. If it is intended for the compositions to possess bactericidal properties, it is preferred that the composition contain from about 0.5% to about 10% of a cationic surfactant, more preferably from about 1.5% to about 3%. The ampholytic and zwitterionic surfactants preferably comprise up to about 10% of such compositions, more preferably up to about 3%.

Amine Impurities

The amine impurities present in the instant compositions are generally the result of incomplete reactions in the formation of the nitrogenous surfactant. These amines can be primary, secondary or tertiary. All such amines adversely affect waxed surfaces and are desirably complexed. A common type of amine impurity found with the aforementioned surfactants is an alkyl dimethyl amine. The level of amine impurities can be determined by a common laboratory technique such as a straightforward acid-base titration wherein a given volume of aqueous surfactant solution is titrated with a standard acid (HCl, $HNO_3$) solution to a bromophenol blue endpoint. The free amine $R_3N$ content in the surfactant solution can be calculated from the volume of standard acid required to reach the endpoint. The quaternized $R_3NH^+$ amine content can be determined by titrating the aqueous surfactant solution with a standard aqueous base (NaOH, KOH) solution to a phenolphthalein endpoint prior to the aforementioned acid titration.

Metal Ion Salt

The materials used to complex the amine impurities present herein are water-soluble salts of metal ions capable of complexing amines. Included among such metals are the transition metals and zinc. The particular metal ion chosen for use herein is not critical, although certain ones are preferred because of availability and other reasons. The same is true of the anionic portion of the salt. The preferred metal ions include zinc, (II), cobalt (II), nickel (II), zirconium (II), titanium (II), copper (II), chromium (II), iron (II), and manganese (II). The preferred anionic portions include the halogens, chlorine, bromine and fluorine, acetate, sulfate and nitrate, among others. By water-soluble herein is meant a solubility of at least 1% by weight at 25° C.

The most preferred salts for use herein are the salts of zinc, cobalt, zirconium and nickel wherein the anionic portion is a halogen, preferably chloride. The most preferred salt is zinc chloride.

As indicated hereinbefore, the metal salt is present in a molar ratio of from about 1:1 to about 1:4, metal salt to amine.

Optional Components

The present compositions can contain as optional components a variety of materials depending on the intended use of the composition. A preferred optional ingredient is a nonionic surfactant which is not nitrogenous and, when the nitrogenous surfactant portion does not contain a cationic surfactant, anionic surfactants. Nonionic synthetic detergents may be broadly defined as compounds produced by the condensation of alkylene oxide groups (hydrophilic in nature) with an organic hydrophobic compound, which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

For example, a well known class of nonionic synthetic detergents is made available on the market under the trade name of "Pluronic." These compounds are formed by condensing ethylene oxide with a hydrophobic base formed by the condensation of propylene oxide with propylene glycol. The hydrophobic portion of the molecule which, of course, exhibits water-insolubility, has a molecular weight of from about 1500 to 1800. The addition of polyoxyethylene radicals to this hydrophobic portion tends to increase the water solubility of the molecule as a whole and the liquid character of the product is retained up to the point where polyoxyethylene content is about 50 percent of the total weight of the condensation product.

Other suitable nonionic synthetic detergents include:

1. The polyethylene oxide condensates of alkyl phenols, e.g., the condensation products of alkyl phenols having an alkyl group containing from about 6 to 12 carbon atoms in either a straight chain or branched chain configuration, with ethylene oxide, the said ethylene oxide being present in amounts equal to 3 to 25 moles of ethylene oxide per mole of alkyl phenol. The alkyl substituent in such compounds may be derived from polymerized propylene, diisobutylene, octene, or nonene, for example.

2. The condensation product of aliphatic alcohols having from 8 to 22 carbon atoms, in either straight chain or branched chain configuration with ethylene oxide, e.g., a coconut alcohol-ethylene oxide condensate having from 3 to 30 moles of ethylene oxide per mole of coconut alcohol, the coconut alcohol fraction having from 10 to 14 carbon atoms.

3. Nonionic detergents include nonyl phenyl condensed with about 10 to about 30 moles of ethylene oxide per mole of phenol; the condensation products of coconut alcohol with an average of either about 5.5 or about 15 moles of ethylene oxide per mole of alcohol; and, the condensation product of about 15 moles of ethylene oxide with one mole of tridecanol.

Other examples include dodecylphenol condensed with 12 moles of ethylene oxide per mole of phenol; dinonylphenol condensed with 15 moles of ethylene oxide per mole of phenol; dodecyl mercaptan condensed with 10 moles of ethylene oxide per mole of mercaptan; nonyl phenol condensed with 20 moles of ethylene oxide per mole of nonyl phenol; myristyl alcohol condensed with 10 moles of ethylene oxide per mole of myristyl alcohol; and di-isooctylphenol condensed with 15 moles of ethylene oxide.

4. A detergent having the formula $R^1R^2R^3P{\rightarrow}O$ (phosphine oxide detergent) wherein $R^1$ is an alkyl group containing from about 10 to about 28 carbon atoms, from 0 to about 2 hydroxy groups and from 0 to about 5 ether linkages, there being at least one moiety of $R^1$ which is an alkyl group containing from about 10 to about 18 carbon atoms and 0 ether linkages, and each of $R^2$ and $R^3$ are selected from the group consisting of alkyl radicals and hydroxyalkyl radicals containing from 1 to about 3 carbon atoms.

Specific examples of the phosphine oxide detergents include: dimethyldodecylphosphine oxide, dimethyltetradecylphosphine oxide, ethylmethyltetradecylphosphine oxide, cetyldimethylphosphine oxide, dimethylstearylphosphine oxide, cetylethylpropylphosphine oxide, diethyldodecylphosphine oxide, diethyltetradecylphosphine oxide, dipropyldodecylphosphine oxide, bis-(hydroxymethyl)dodecylphosphine oxide, bis-(2-hydroxyethyl)dodecylphosphine oxide, (2-hydroxypropyl)methyltetradecylphosphine oxide, dimethyloleylphosphine oxide, and dimethyl-(2-hydroxydodecyl)phosphine oxide and the corresponding decyl, hexadecyl, and octadecyl homologs of the above compounds.

5. A detergent having the formula

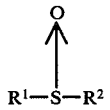

(sulfoxide detergent) wherein $R^1$ is an alkyl radical containing from about 10 to about 28 carbon atoms, from 0 to about 5 ether linkages and from 0 to about 2 hydroxyl substituents at least 1 moiety of $R^1$ being an alkyl radical containing 0 ether linkages and containing from about 10 to about 18 carbon atoms, and wherein $R^2$ is an alkyl radical containing from 1 to 3 carbon atoms and from 1 to 2 hydroxyl groups: e.g., octadecyl methyl sulfoxide, dodecyl methyl sulfoxide, tetradecyl methyl sulfoxide, 3-hydroxytridecyl methyl sulfoxide, 3-methoxytridecyl methyl sulfoxide, 3-hydroxy-4-dodecoxybutyl methyl sulfoxide, octadecyl 2-hydroxyethyl sulfoxide, and dodecylethyl sulfoxide.

The anionic surfactants which may be present in certain of the present compositions include water-soluble salts, particularly the alkali metal salts, of organic sulfuric reaction products having in their molecular structure an alkyl substituent containing from about 8 to about 22 carbon atoms and a sulfonic acid or sulfuric acid ester moiety. (Included in the term alkyl is the alkyl portion of higher acyl substituent.) Examples of this group of synthetic detergents which may form a part of the compositions of the present invention are the sodium or potassium alkyl sulfates, especially those obtained by sulfating the higher alcohols ($C_8$–$C_{18}$ carbon atoms) produced by reducing the glycerides of tallow or coconut oil; sodium or potassium alkyl benzene sulfonates, in which the alkyl group contains from about 9 to about 15 carbon atoms in straight chain or branched chain configuration, e.g., those of the type described in U.S. Pat. Nos. 2,220,099 and 2,477,383 (especially valuable are linear straight chain alkyl benzene sulfonates in which the average of the alkyl groups is about 13 carbon atoms and commonly abbreviated as $C_{13}$LAS); sodium alkyl glyceryl ether sulfonates, especially those ethers of higher alcohols derived from tallow and coconut oil; sodium coconut oil fatty acid monoglyceride sulfonates and sulfates; sodium or potassium salts of sulfuric acid esters of the reaction product of 1 mole of a higher fatty alcohol (e.g., tallow or coconut oil alcohols) and about 1 to 6 moles of ethylene oxide; sodium or potassium salts of alkyl phenol ethylene oxide ether sulfate with about 1 to about 10 units of ethylene oxide per molecule and in which the alkyl radicals contain about 8 to about 12 carbon atoms.

The above-mentioned optional surfactants, if present, are present at a total level of up to about 15%. If the optional surfactant is nonionic alone, it is preferably present at a level of up to about 10%, more preferably up to about 2%.

Another optional ingredient suitable for use herein are pH control agents which are compatible with the metal salts. Included among such agents are borate, sulfate, citrate, acetate and succinate buffers. When such agents are used, they are present at a level of about 1% to 20%.

For aesthetic purposes the present compositions can contain perfumes and dyes in an amount up to about 0.5%. Additional agents such as preservatives (e.g., glutaraldehyde), thickeners, hydrotropes, opacifiers, solvents (e.g., ethyl alcohol, isopropyl alcohol, glycerin and glycols) and stabilizers may also be present. Additionally, phenolic antibacterial agents may be present as the only antibacterial or in combination with others.

Composition Manufacture

The compositions of the present invention are prepared by conventional mixing techniques. The order of addition of the components is not critical and the components are simply mixed together until solution is achieved.

Composition Usage

The present compositions can be used either at full strength or in a diluted form on the surface to be cleaned. The composition, if diluted, is generally mixed with water in an amount of one part composition to about 64 parts of water. The treated surface is rubbed in an oscillating manner with a sponge or other similar material to distribute the composition. If desired the surface can be rinsed with clean water. When used at full strength, the composition is used in an amount of from about 0.05 gms. to 3.00 gms. per square foot of surface.

A preferred composition for use herein contains from about 1.5% to 3% of a bactericidal quaternary ammonium compound, up to 3% of a zwitterionic surfactant, up to 2% of a nonionic surfactant, about 0.0025% to 0.05% of zinc chloride, an amount of a pH control agent to provide a pH of about 6 to 8, and water.

Maintaining the pH of the present type of products in the acidic range helps to prevent polish damage. The reason for this is that the free amines tend to be quaternized at such pH's and the susceptible polishes are more stable in an acidic environment that in an alkaline environment. However, in order to maintain the effectiveness of bactericidal quaternary ammonium compounds it is desirable to maintain the pH above about 6.

All percentages used herein are by weight unless otherwise specified.

The invention will be further illustrated by the following examples.

EXAMPLE I

A composition of the present invention is formulated as shown below:

| | |
|---|---|
| Cetyl trimethylammonium bromide | 3.00% |
| 3-(N,N-dimethyl-N-$C_{12.8}$ alkylammonio)-2-hydroxy propane-1-sulfonate (HAPS) | 1.60 |
| Secondary alcohol ethoxylate nonionic surfactant ($C_{11-15}$; EO-9) | 1.00 |
| Perfume | 0.50 |
| Zinc chloride | 0.005 |
| Water | Balance |
| | 100.00% |

-continued

| |
|---|
| pH = 7.0 |

When the above composition is used on a polished surface at full strength in an amount of 0.45 grams per square foot, the wax does not soften or smear as it does when the identical composition with the zinc chloride removed is used.

EXAMPLE II

A composition is formulated similar to that of Example I except that the HAPS level is reduced to 0.4% and the nonionic surfactant is eliminated. The performance of this composition on polished surfaces is similar to that of the composition of Example I.

EXAMPLE III

A composition is formulated similar to that of Example I except that the zinc chloride level is reduced to 0.01%. The performance of this composition is similar to that of the composition of Example I.

EXAMPLE IV

A composition is formulated similar to that of Example I except that zinc chloride salt is replaced by the acetate, bromide, sulfate or nitrate salt of zinc, cobalt or nickel. Performance of compositions containing these salts is similar to that of the composition of Example I.

What is claimed is:

1. A hard surface cleaning composition especially suited for cleaning polished surfaces comprising:

A. from about 0.5% to about 20% of an amine-derived nitrogenous surfactant;

B. amine impurities which are introduced into said composition with said nitrogenous surfactant;

C. a water-soluble salt of a metal ion capable of complexing said amines in an amount such that the molar ratio of said salt to said amines is from about 1:1 to 1:4; and D. water;

the pH of said composition being from about 6 to 8.

2. A composition according to claim 1 wherein the nitrogenous surfactant is selected from the group consisting of cationic surfactants, ampholytic surfactants, zwitterionic surfactants, nonionic surfactants and mixtures thereof.

3. A composition according to claim 2 wherein the nitrogenous surfactant component is a cationic surfactant in an amount of from about 0.5% to 10% by weight of the composition and the water-soluble metal ion salt is selected from the group consisting of the salts of transition metals and zinc.

4. A composition according to claim 3 wherein the water-soluble metal ion salt is selected from the group consisting of the water-soluble salts of zinc, cobalt, nickel and zirconium.

5. A composition according to claim 4 wherein in addition to the cationic surfactant a zwitterionic or ampholytic surfactant in an amount up to about 10% by weight of the composition is also present.

6. A composition according to claim 5 wherein the cationic surfactant is present in an amount of from about 1.5% to 3% and the zwitterionic or ampholytic detergent is present in an amount of up to about 3%.

7. A composition according to claim 6 wherein the water-soluble metal ion salt is a water-soluble zinc salt.

8. A composition according to claim 7 wherein a nonionic surfactant which is not nitrogenous is also present in an amount up to about 2%.

9. A composition according to claim 8 wherein the ampholytic or zwitterionic surfactant is zwitterionic.

10. A composition according to claim 9 wherein the cationic surfactant is selected from the group consisting of alkyl dimethylbenzylammonium chloride, alkyl pyridinium chloride, alkyl trimethylammonium chloride, and mixtures thereof wherein the alkyl groups contain from about 12 to 18 carbon atoms.

11. A process for removing soil from hard surfaces which bear a polish cross-linked by metal ions comprising the following steps:

A. applying to said surface from about 0.05 gms. to 3.00 gms. per square foot of a composition comprising:

a. from about 0.5% to about 20% of an amine-derived nitrogenous surfactant;

b. amine impurities which are introduced into said composition with said nitrogenous surfactant;

c. a water-soluble salt of a metal ion capable of complexing said amines in an amount such that the molar ratio of said salt to said amines is from about 1:1 to 1:4; and d. water;

and

B. distributing said composition in an oscillating manner over the entire area of said surface.

12. A process according to claim 11 wherein the nitrogenous surfactant in the composition is selected from the group consisting of cationic surfactants, ampholytic surfactants, zwitterionic surfactants, nonionic surfactants and mixtures thereof.

13. A process according to claim 12 wherein the composition contains from about 1.5% to 3% of a cationic surfactant, a zwitterionic or ampholytic surfactant in an amount of up to about 3%, up to 2% of a nonionic surfactant which is not nitrogenous and zinc chloride as the water-soluble salt of a metal ion.

* * * * *